United States Patent [19]

Morishita et al.

[11] Patent Number: 4,658,484

[45] Date of Patent: Apr. 21, 1987

[54] KNIT TAPE MANUFACTURING DEVICE

[75] Inventors: Seizo Morishita, Suita; Tamotsu Sumoto, Toyonaka, both of Japan

[73] Assignee: Yugen Kaisha Manthree Shokai, Osaka, Japan

[21] Appl. No.: 785,891

[22] Filed: Oct. 8, 1985

[30] Foreign Application Priority Data

Sep. 10, 1985 [JP] Japan ..... 60-200891

[51] Int. Cl.[4] ..... B21D 43/00; B26D 3/00

[52] U.S. Cl. ..... 29/2.15; 29/2.21; 83/175; 83/180; 83/187

[58] Field of Search ..... 83/175, 176, 179, 180, 83/183, 187, 494; 29/2.11–2.25

[56] References Cited

U.S. PATENT DOCUMENTS

| | | | |
|---|---|---|---|
| 676,585 | 6/1901 | Nenell | 29/2.2 X |
| 1,865,304 | 6/1932 | Bunker | 29/2.16 |
| 1,896,596 | 2/1933 | Seddon | 29/2.21 X |
| 2,110,856 | 3/1938 | Gardner et al. | 29/2.21 X |
| 4,131,979 | 1/1979 | King et al. | 83/180 X |
| 4,516,736 | 5/1985 | Anderson | 83/494 X |

*Primary Examiner*—James M. Meister

*Attorney, Agent, or Firm*—Koda and Androlia

[57] ABSTRACT

A knit tape manufacturing device comprising a framework, a driver supported on the framework, a feeding and guiding mechanism composed of a plurality of feeding means which, arranged peripherally, are rotatorily driven on the framework about a longitudinal axis by the driver through a power transmission mechanism and fed under guidance along a longitudinal direction a circular knitted fabric stretched externally therearound, an operating mechanism which operates the feeding means by the driver, and a cutting means for cutting spirally the rotating circular knitted fabric into a tape of width corresponding to the specific feed length which is located adjacent to the forward end of the feeding and guiding mechanism.

6 Claims, 11 Drawing Figures

KNIT TAPE MANUFACTURING DEVICE

BACKGROUND OF THE INVENTION

1. Field of the Invention

The present invention relates to a device for manufacturing knit tape by continuously and spirally cutting a circular knitted fabric.

2. Prior Art

As such knit tape manufacturing device has so far been known the present applicant's Japanese Provisional Patent Publication No. 59974 of 1984.

This conventional knit tape manufacturing device has, as shown in FIG. 7, a circular knitted fabric N stretched around a driving drum 91, driven drum 92 and tension roller 93. The driven drum 92 is caused to pivot about a fulcrum 98 and incline through a working rod 96 with handle, and the drum 92 is supported through a link 97 so that contact line t at a point $P_1$ coincides with the axial line of a fulcrum 98 while the top rim of the circular knitted fabric N with respect to the driven drum 92 advances at a fixed point $P_1$ even if the inclination angle of the drum 92 is changed.

The top rim of the circular knitted fabric N, which is held diagonally upward through the inclination of the driven drum 92 is guided by the tension roller 93 and cut with a cutter 94 positioned adjacent to the top rim of the driving drum 91 into tape n which is wound up by the wind-up bar 95.

Although the above-described conventional knit tape manufacturing device has a merit of being simple in construction, but the circular knitted fabric N is stretched only by the driving drum 91, driven drum 92 and tension roller 93 and the holding area with regard to the circular knitted fabric N is small. Hence, during the manufacture of the tape the top rim of the circular knitted fabric is subject to fluctuation and it is difficult to make a tape of constant width.

SUMMARY OF THE INVENTION

It is the object of the present invention to solve the above-described problem. More particularly the present invention is aimed at providing a knit tape manufacturing device incorporated with a feeding and guiding mechanism for enabling cutting continuously and spirally into a tape of the predetermined width from the circular knitted fabric which is rotated circumferentially and fed longitudinally while its inner peripheral surface being brought into uniform contact for a given length with the outer peripheral surface of said mechanism. Moreover, the feeding and guiding mechanism has its diameter adjustable according to the inner diameter of the circular knitted fabric to be cut, and the position of the cutting means is made adjustable according to the diameter of the feeding and guiding mechanism.

The means of the present invention for accomplishing the above purpose is a knit tape manufacturing device comprising a framework, a driver supported on the framework, a feeding and guiding mechanism composed of a plurality of feeding means which, arranged peripherally, are rotatively driven on the framework about a longitudinal axis by the driver through a power transmission mechanism and feeds under guidance along a longitudinal direction a circular knitted fabric stretched externally therearound, an operating mechanism which operates the feeding means by the driver, and a cutting means for cutting spirally the rotating circular knitted fabric into a tape of width corresponding to the specific feed length, which is located adjacent to the forward end of said feeding and guide mechanism, and a diameter adjusting mechanism uniformly expanding and contracting the feeding and guiding mechanism radially and a position adjusting mechanism for positioning the cutting means always on its external surface following its diametrical change.

According to the present invention, a tape of the given width is continuously cut off spirally from the open end of a circular knitted fabric with good stability. The feeding and guiding mechanism which rotates peripherally and feeds longitudinally the circular knitted fabric by a plurality of feeding means provided peripherally and the cutting means cuts spirally and continuously by open end of the circular knitted fabric being fed longitudinally as well as peripherally into a tape.

For circular knit fabrics different in diameter it can be dealt with by connecting a diameter adjustment mechanism with the feeding and guiding mechanism and the cutting means with the position adjusting mechanism.

BRIEF DESCRIPTION OF THE DRAWINGS

Described below is a representative embodiment of the present invention under reference to the accompanying drawings, of which:

FIG. 3(*b*) is a plan view of the same feeding means.

FIG. 4(*b*) is enlarged views of the parts F and G shown in FIG. 4(*a*).

FIG. 4(*c*) is an enlarged view of the part E shown in FIG. 4(*a*).

DETAILED DESCRIPTION OF THE PREFERRED EMBODIMENT

Figure 1:
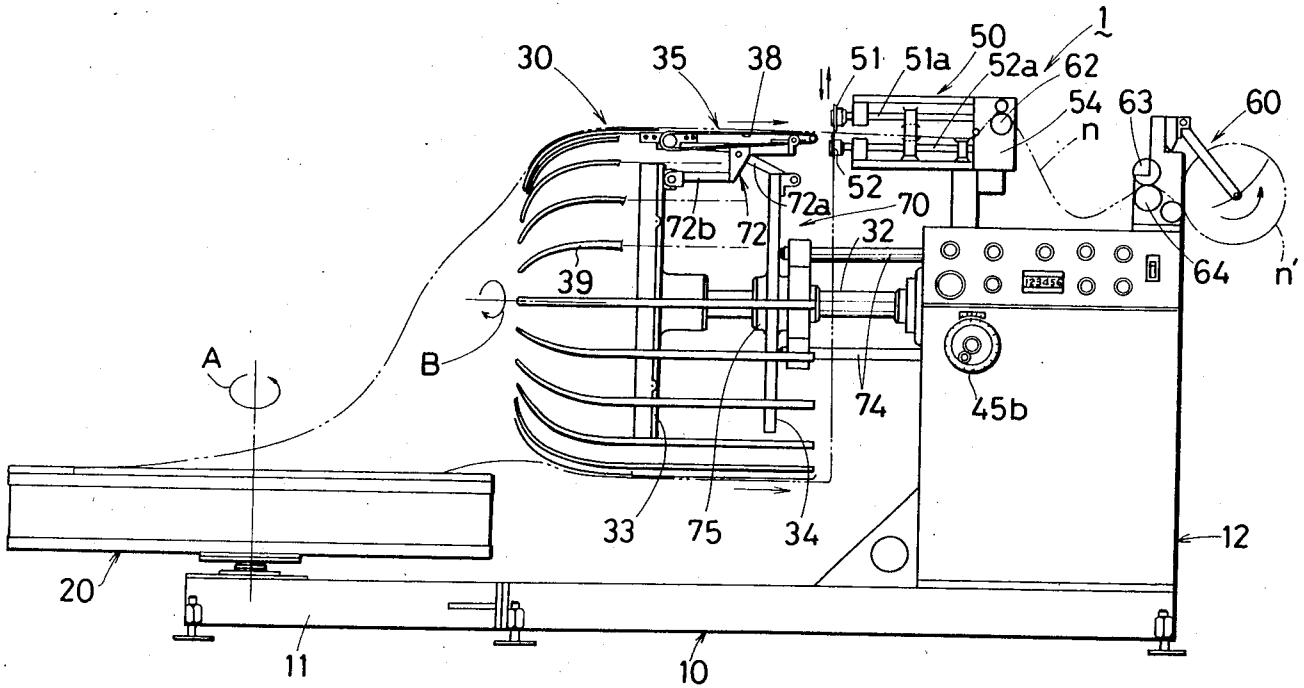
FIG. 1 is a front view of an embodiment of the knit tape manufacturing device of the present invention.
Figure 2:
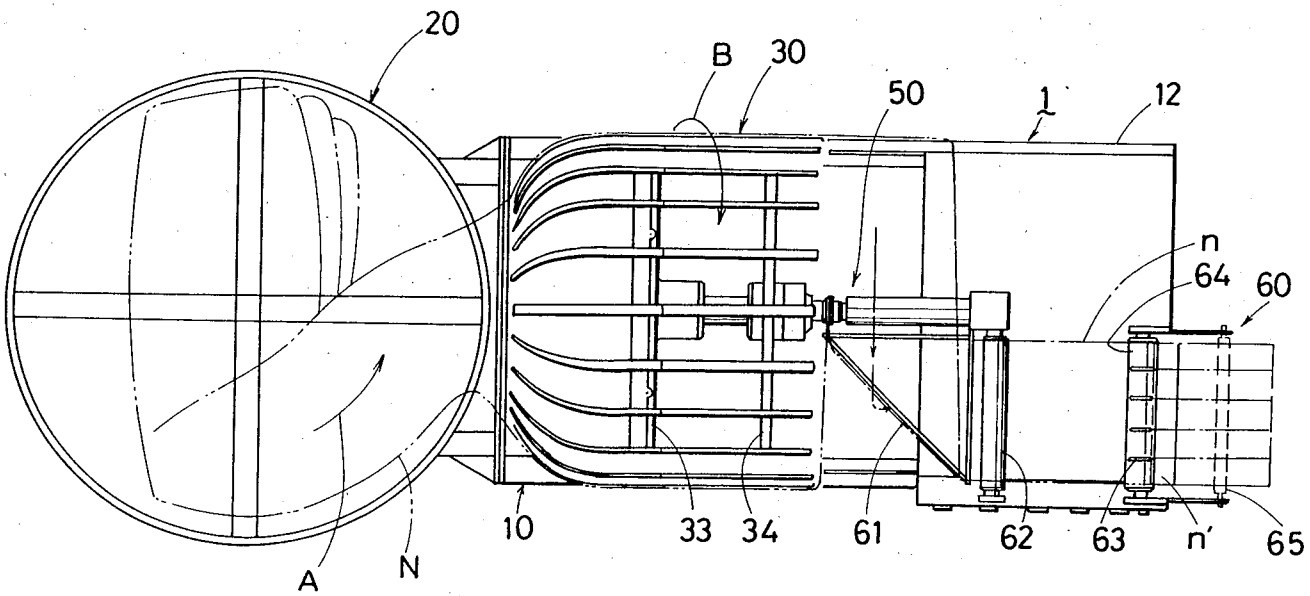
FIG. 2 is a plan view of the same embodiment.
Figure 3:
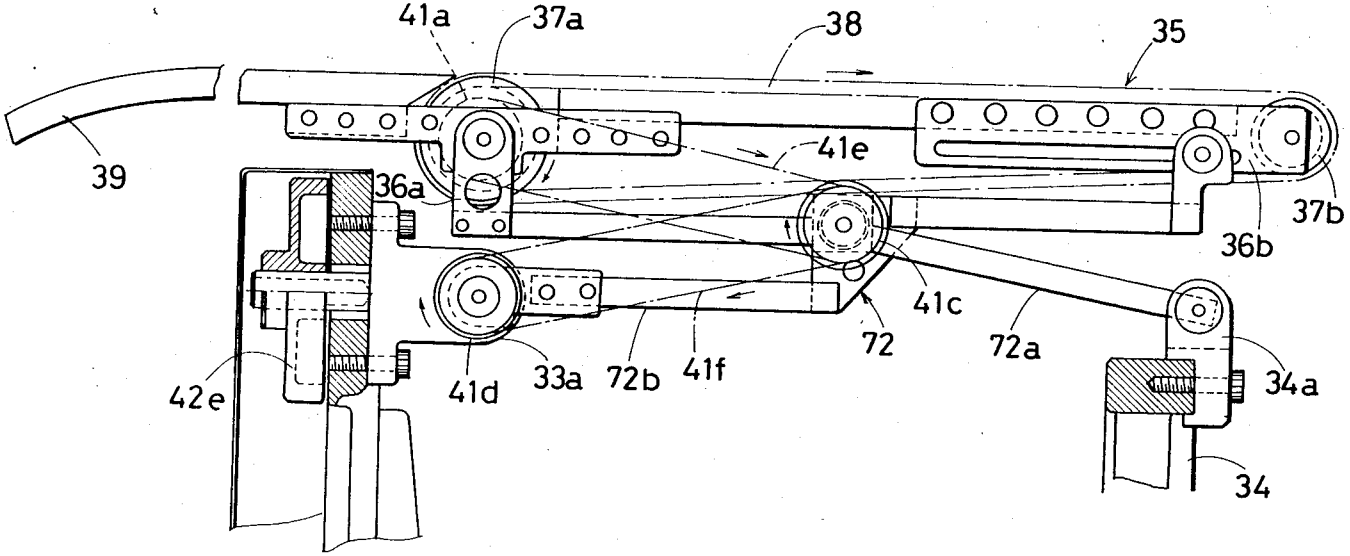
FIG. 3(*a*) is a front view of the feeding means adopted in the same embodiment.
Figure 3:
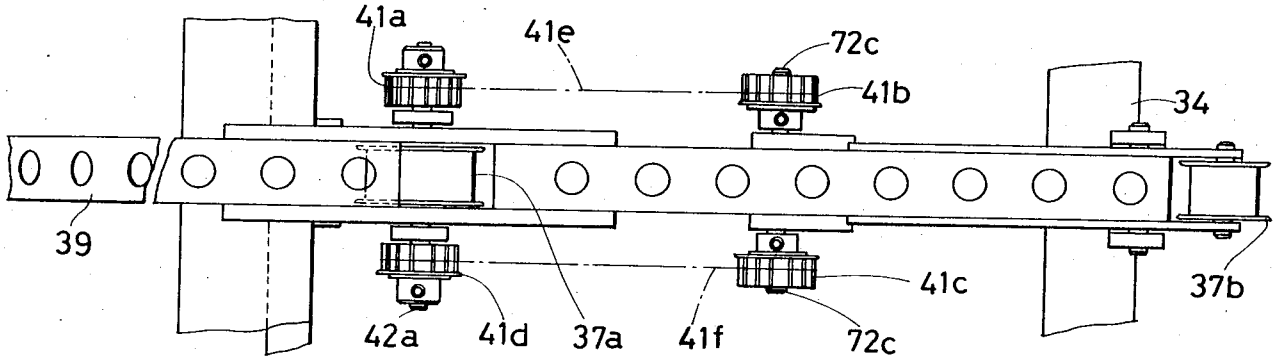

Referring to the annexed drawings FIG. 1 through FIG. 6(*b*), the knit tape manufacturing device 1 of the present invention comprises a turn table 20 on which a circular knitted fabric N formed as a tubular fabric knitted out of cotton is folded, a feeding and guiding mechanism 30 which feeds the open end portion of the circular knitted fabric stretched externally therearound toward the box frame side, an operating mechanism 40 which operates a plurality of feeding means 35 arranged peripherally of the feeding and guiding mechanism 30, a cutting means 50, which is arranged on the box frame 12 adjacent to the circular knitted fabric open end and cuts the circular knitted fabric N being fed rotating into a knit tape n with its width corresponding to the specific feeding rate, a winding mechanism 60 for winding cut tape n, a diameter adjusting mechanism 70 which radially increases or decreases uniformly the outer diameter of the feeding and guiding mechanism 30 and a position adjusting mechanism 77 which adjusts the positions of rotary blades 51 and 52 of the aforesaid cutting means 50 so that they are always set at the fixed position relative to the mechanism 30 synchronously with change in outer diameter of the aforesaid feeding and guiding mechanism 30.

The turn table 20 has a supporting spindle 21 with a bevel gear 22*a* fixed thereon at the center in the bottom thereof, and is rotatively driven by an electric motor 81 and reduction gear 82 through a horizontal intermediate shaft 24 on which a bevel gear 22*b* is engaged with the aforesaid bevel gear 22*a* at one end thereof and has a timing belt pulley 23 at the other end thereof. Both bevel gears 22*a* and 22*b* have a gear ratio of 1:1 and the diameter of the pulley 23 is the same as that of a pulley 31 driven by the motor 81 through the reduction gear 82 through a timing belt 83, and the turn table 20 are rotatively driven in the direction of an arrow A in synchronous with the feeding and guiding mechanism 30.

The feeding and guiding mechanism 30 comprises a large diameter disc 33 fixed perpendicularly at one end of a hollow outer shaft 32 supported rotatively and horizontally on a box frame 12, on the other end of which the aforesaid pulley 31 is fixed, a small diameter ring 34 supported to be freely rotated with its longitudinally limited position through the outer periphery of a bearing ring 75 on the outer shaft 32, and a large number, for example, 20 sets of feeding means 35 peripherally through X-link mechanism 72 composed by legs freely openable and closable of the diameter adjusting mechanism 70 arranged between the disc 33 and ring 34. And this mechanism 30 is rotated in the direction of arrow B by the motor 81 through a timing belt 81*b*, pulley 82*a* and reduction gear 82 of which output pulley 82 drives a belt 83 and pulley 31 fixed on the outer shaft 32. The feeding means 35 are mutually connected with pins to be freely rotatable and consists of brackets 36*a* and 36*b* fitted outer ends of a pair of 72*a* and 72*b* which comprises belt pulleys 37*a* and 37*b* which are rotatably supported on brackets 36*a*, 36*b* pivoted on the outer ends of the X-link mechanism and belt 38 set between these pulleys 37*a* and 37*b*. The belt 38 is lined outside with a thin layer of sponge with its high friction coefficient for effectively feeding the circular knitted fabric N. The bracket 36*a* of the disc 33 side is linked to the link 27*a*, and the other bracket 36*b* is linked to the link 72*b* through a slot and a sliding pin so as to allow opening and closing of the X-link mechanism 72. The inner end of the link 72*a* is pivotally supported by the supporting bracket 34*a* externally on the periphery of the ring 34 of small diameter. The inner end of the link 72*b* is freely rotatably pivoted by the supporting body 33*a* provided on the outer peripheral portion of the large-diameter disc 33. The bracket 36*a* has an inverted ski shaped guide bar 39 fitted thereto on the same level as the outside of the belt 38.

The operating mechanism 40 for operating the above-mentioned feeding means 35 comprises a timing belt transmission part 41, a geared power transmission means 42 provided on the external side of the disc 33, an intermediate inner shaft 43 set freely rotatably within the hollow outer shaft 32 to the aforesaid transmission means 42, an intermediate timing belt transmission part 44 composed of a timing belt pulley 44*a* fixed on the input end of the shaft 43, a timing belt pulley 44*b* fixedly set on the output shaft of a speed change gear 45 as a relative speed difference adjusting means between the above two shafts 32 and 43 and a timing belt 44*c* set around pullies 44*a*, 44*b*, the speed change gear 45 and an input portion 46 including a timing belt pulley 46*a* which receives the torque from the motor 81 through a timing belt 81*b* and the gear 45. Further, the aforesaid timing belt transmission part 41 comprises, as shown in detail in FIG. 3(*a*), (*b*) and FIG. 4(*a*), a timing belt pulley 41*a* coaxially connected with a belt pulley 37*a* supported by a fixed bracket 36*a*, an intermediate timing belt pulley 41*b* and 41*c* fixed at both ends of a central connection pin 72*c* of the X-link mechanism 72, a timing belt pulley 41*d* and timing belt 41*e* and 41*f* set around individual pair of pulleys.

Figure 6:
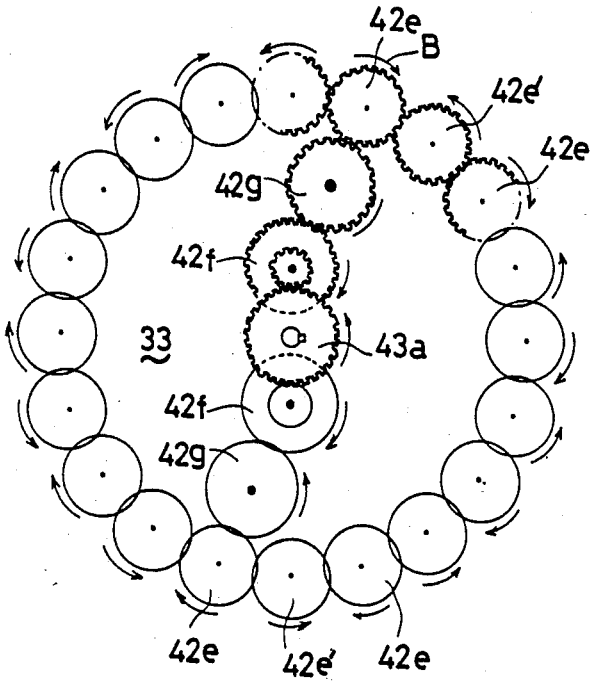
FIG. 6(*a*) and (*b*) are illustratory views showing the arrangement of gears in the geared power transmission means adopted for the embodiment.
Figure 6:
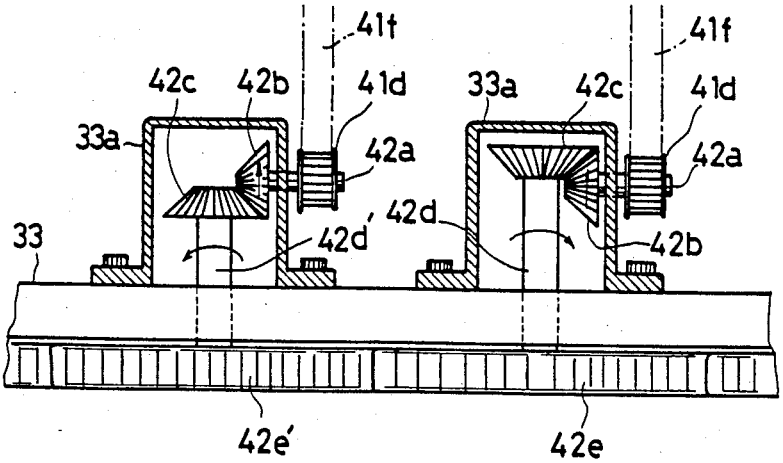
Figure 7:
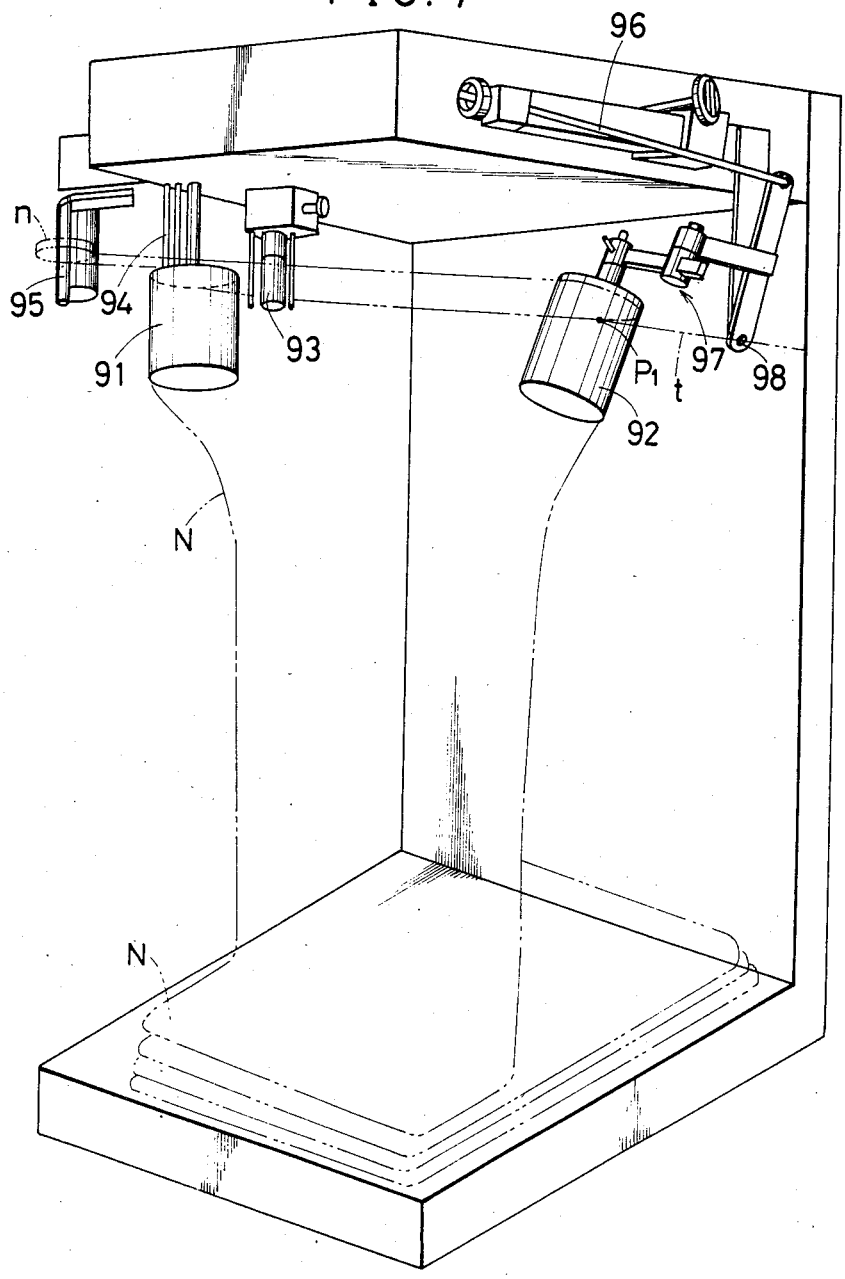
FIG. 7 (Prior art)
FIG. 7 is a perspective view of a conventional knit tape manufacturing device.

The aforesaid geared power transmission means 42 comprises, as shown in detailed in FIG. 6(*a*) and (*b*), a bevel gear 42*b* fixedly set on the inner end of the pin 42*a* and housed in the cavity of the supporting body 33*a*, pin 42*d* and 42*d*' fixedly setting thereon spur gears 42*e* and 42*e*' respectively on their outer ends on the external side of the disc 33 with the disc 33 as bearing, and intermediate gears 42*f* and 42*g* which are mutually engaged and disposed in two rows between the spur gear 42*e* and a central spur gear 43*a* fixed to the outer end of the aforesaid intermediate driving shaft 43.

The aforesaid change gear 45 is provided with an input sprocket wheel 45*a* for speed change which serves to change the rotary speed outputted by the timing belt pulley 44*b* relative to the rotary speed inputted to the timing belt pulley 46*a* on the input shaft and the speed variation ratio is adjustable by means of an adjusting handle 45*b* and chain 45*c*. The spur gears engaged mutually on the periphery of the disc 33 consist of those made of cast steel 42*e* and those made of nylon 42*e*' alternatively for the desired silence feature.

The cutting means 50 comprises a pair of rotary blades 51 and 52 arranged on a supporting frame 54 and laid parallel to the rotation direction (arrow B) of the feeding and guiding mechanism 30 so that the cutting point is roughly on the same level as the outside face of the feeding belt 38 of the feeding means 35 and the torque transmitting means 53 for transmitting torque so that cutting force acts in the direction of the arrow B to the supporting shafts 51*a* and 52*a*. One of the rotary blades 51 is urged against the other blade 52 by an elastic member such as a spring.

Figure 4:
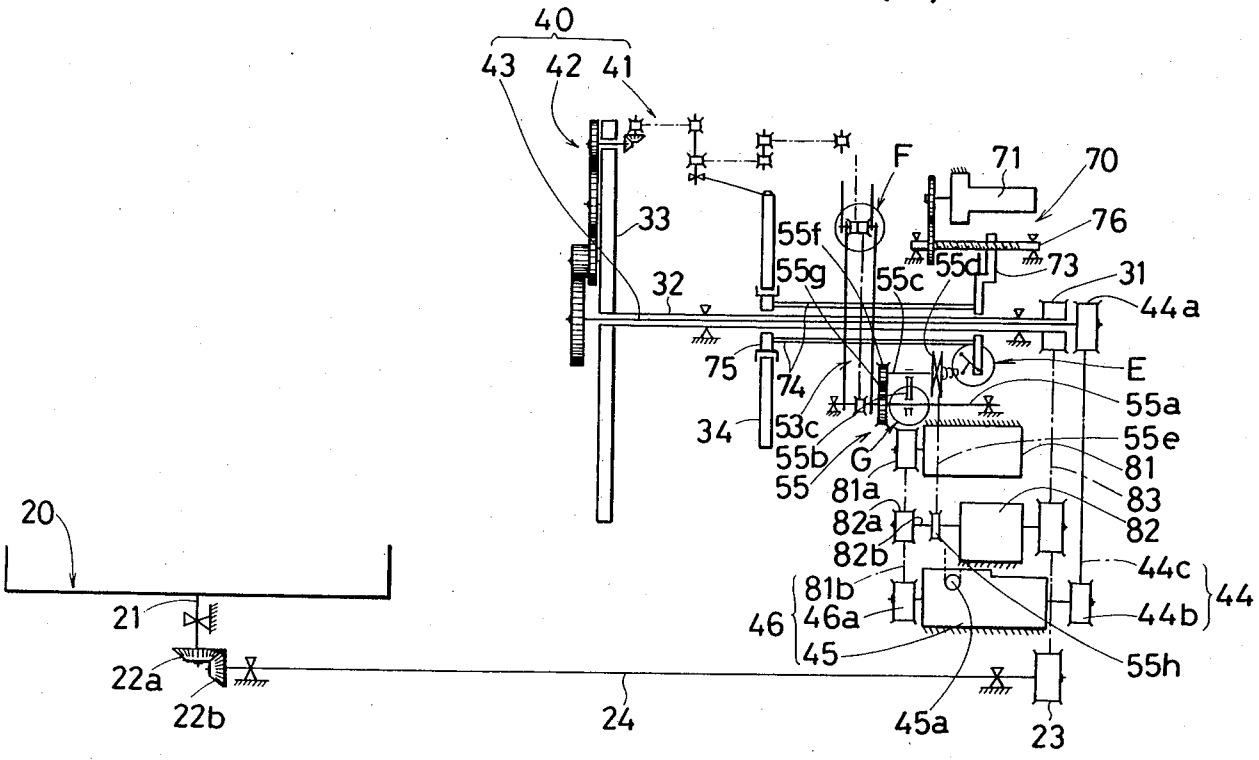
FIG. 4(*a*) is a illustratory view showing the power transmitting route of the aforesaid embodiment.
Figure 4:
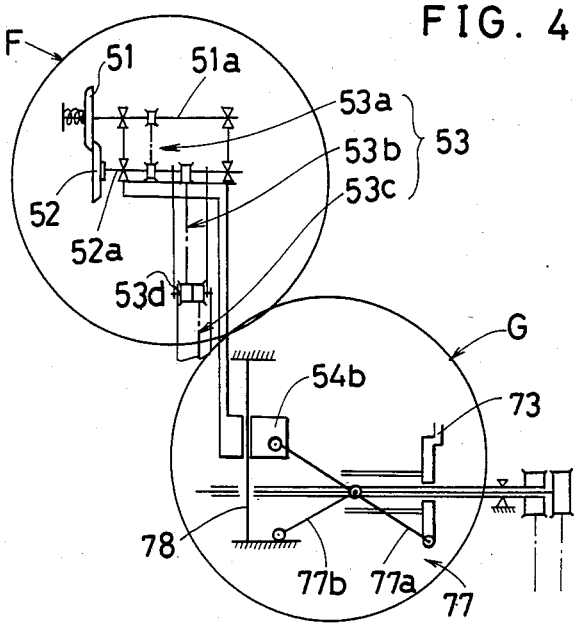
Figure 4:
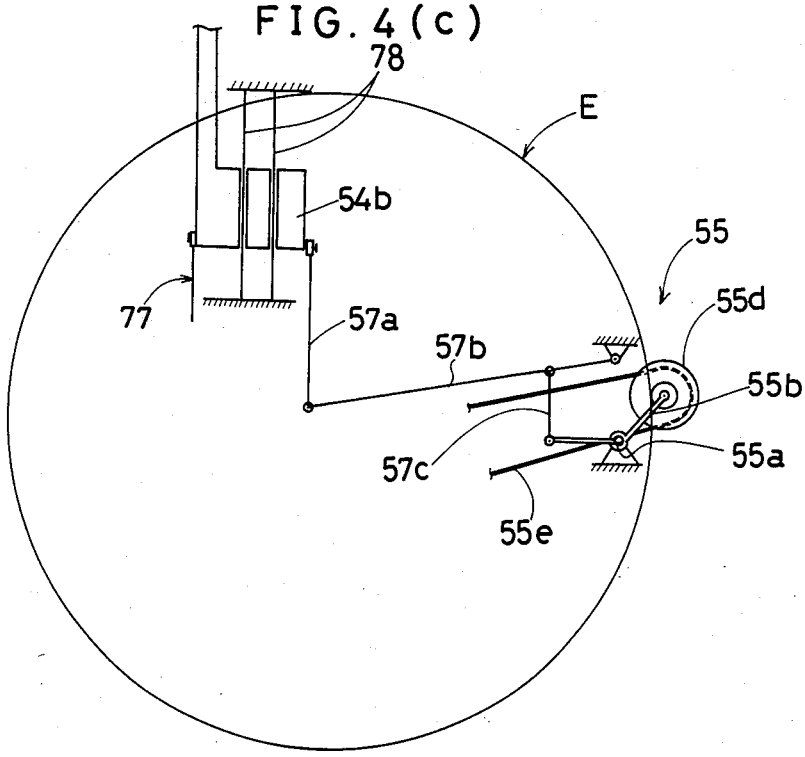
Figure 5:
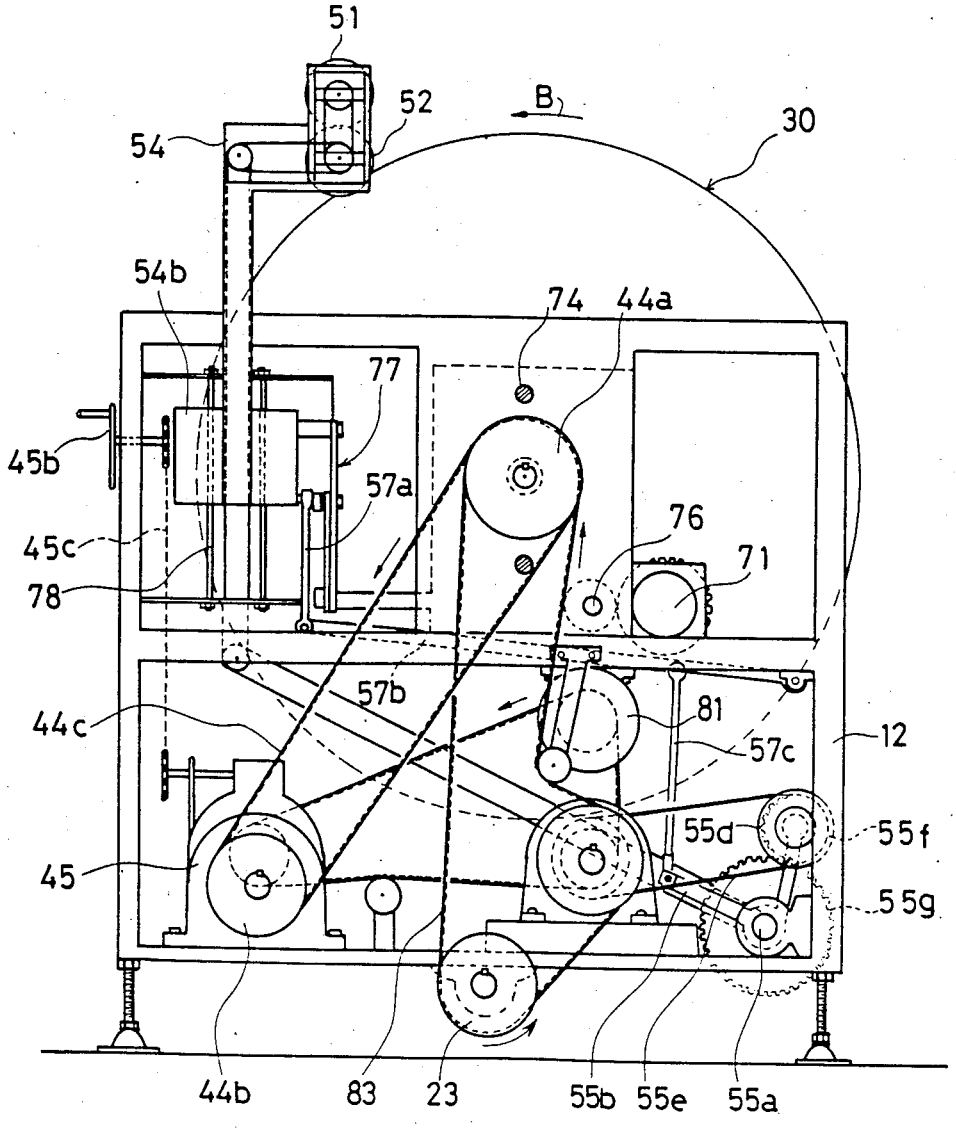
FIG. 5 is the right side view of the above embodiment.

The torque transmitting means 53 consists of a first intermediate transmitting portion 53*a* of the above supporting shafts comprising a pair of timing belt pulleys and a timing belt set therebetween, a second intermediate transmitting portion 53*b* between a supporting shaft 52*a* and an intermediate joint pin 53*b* and a third intermediate transmitting portion 53*c* between the intermediate joint pin 53*b* and a rotary speed adjusting means 55, and a rotary speed adjusting means 55. The rotary speed adjusting means 55 is for adjusting the rotary speed so as to be equal to the peripheral speed of the mechanism 30 at the cutting positions of the rotary blades 51 and 52 linking with the motion of the diameter adjusting mechanism 70 for the peripheral speed changes when the diameter of the aforesaid feeding and guiding mechanism 30 is caused to change by the diameter adjusting mechanism 70, and as shown in detail in FIG. 4(*a*) and FIG. 4(*c*), the torque of the motor 81 inputted to the V-belt pulley 55*h* set on the input shaft 82*b* of the reduction gear 82, is transmitted to a variable V pulley 55*d* fixedly set on the freely turning shaft 55*c* set on a swing arm 55*b* interlocked with the diameter adjusting mechanism 70 supported swingably by the aforesaid output shaft 55*a* through a V belt 55*e* and torque is transmitted to the output shaft 55*a* through a pinion gear 55*f* fixedly set on the outer end of the shaft 55*c* and through a gear 55g fixed set on the output shaft 55a. The variable speed V-pulley 55d is now widely marketed, consists of 2 pulley discs urged against each other, which are opened by the tension of a V-belt 55e and the peripheral speeds of the rotary blades 51 and 52 in proportion to the decrease of the pitch circle at the same ingredient as the proportional relationship of the variation of its peripheral speed. As shown in FIG. 4(c), the link mechanism varying the swinging angle of the swing arm 55b interlocked with the operation of the diameter adjusting mechanism 70, is composed of an arm 57a linked with a pin to base 54b of the frame 54 described below, a lever 57b connected at one end with the arm and pin-connected with a frame 12 at the other end and working lever 57c pin-connected to the action part of the arm 55b and the intermediate part of the lever 57b.

The diameter adjusting mechanism 70 comprises a reversible motor 71 as driver, a ball screw 76 rotatively driven by the motor 71 through gears in the box frame 12, a moving plate 73 which moves on the hollow shaft 32 as the ball screw rotates, a pair of guide bars 74 for the moving plate 73, the bearing ring 75 interlocked with the plate 73 through a pair of guide rods 74, the ring 34 rotatably supported at the periphery of the bearing ring 75 while moving fore and back with the bearing ring 75 on the hollow supporting shaft 32, and the X-link mechanism 72 for supporting the aforesaid feeding means 35 arranged equidistant peripherally between the ring 34 and the disc 33. The moving plate 73 has connected thereto a push-up link mechanism 77 as the position adjusting mechanism 77 whose inter-fulcrum distance is the same with the aforesaid link mechanism 72 and which makes the cutting means 50 follow the variation in diameter of the aforesaid feeding and guiding mechanism 30. This push-up link mechanism 77 consists of a long link 77a whose one end portion is pin-connected with the lower end portion of the moving plate 73 and whose the other end portion pin-connected freely rotatably with the base 54b of the supporting frame 54 and a short link 77b whose one end portion is pin-connected to be freely rotatable at its center and whose the other end is pin-connected again freely rotatably with the box frame 12. The base 54b is freely slidably fitted on the guide bars 78, 78 fixed to the box frame 12 in parallel and vertically.

The winding mechanism 60 comprises a tension bar 61 which changes the direction of the tape n to the longitudinal direction of the framework 10 immediately after cutting a feeding roller 62 for the tape n, a plurality of cutting blades 63 . . . for cutting into tapes n' smaller in width, a platen roller 64 (which is rotatorily driven by the torque transmitted from the rotary shafts 51a and 52a for blades 51, 52) and swingable winding bar 65 for winding the tapes n' which are in contact with the platen roller 64 as they are wound.

As the electric motor 81 as driver is used a variable speed motor, whose speed can be adjusted for efficient cutting of the tape n according to the material and inside diameter of of the circular knitted fabric N.

Then summarized in the operation of the knit tape manufacturing device 1 of the present embodiment. First the power is turned on and the outer diameter of the feeding and guiding mechanism 30 is adjusted by means of the diameter adjusting mechanism 70 to be slightly larger than the inner diameter of the circular knitted fabric N folded on the turn table 20. When, for instance, the outer diameter is to be increased, the moving plate 73 is to be moved to the turn table 20 side by means of the motor 71 so as to move the ring 34 toward the disc 33, close the legs of the X-link mechanism 72 and expand the feeding means 35 so as to increase the outer diameter of the feeding and guiding mechanism 30. Following the increase of the outer diameter of the mechanism 30, the cutting means 50, too, has its supporting frame 54 raised by the push-up link 77 interlocked with the diameter adjusting mechanism 70 and is adjusted to a predetermined position with respect to the feeding and guiding mechanism 30. The motor 81 is started after pulling the circular knitted fabric N onto the outer periphery of the mechanism 30 with a proper tension. The rotation speed of the feeding and guiding mechanism 30 is determined by the material and inner diameter of the circular knitted mechanism 30 and the turn table 20, too, is turned to offset distortion of the circular knitted fabric N by the rotation of the mechanism 30. Since a timing belt 81b is provided to make rotation of the feeding means 35 and its longitudinal feeding in common, the width of the tape n is determined by the speed of feeding of the circular knitted fabric N by the feeding means 35 in the direction of the cutting means 50. This is, when the both shafts 32 and 43 are driven at the same rotary speed lest any relative speed difference between the hollow shaft 32 and the intermediate inner shaft 43 set therethrough, the central gear 43a of the operation mechanism 40, too, rotates at the same speed as the disc 33, and the other gears 42a, 42e', 42f and 42g do not rotate with respect to the disk 33. Hence the feeding speed becomes zero. When the rotary speed of the intermediate inner shaft 43 is made slower than the hollow shaft 32, a central gear 43a is rotated in the opposite sence relative to the disc 33, then circulates a timing belt transmission part 41 through a gear transmission part 42, and finally circulates a belt 38 of the feeding means so as to feed the circular knitted fabric N in contact therewith in the direction toward the cutting means 50. The maximum width can be obtained by zeroing the rotary speed of the intermediate inner shaft 43 to give rise to the maximum relative speed difference.

By the cutting means 50 with its rotary blades 51 and 52 set at the outside position of the belt 38 of the feeding means the circular knitted fabric N fed peripherally and longitudinally by the feeding and guiding mechanism 30 is cut spirally into tape n of a given width and the cut tape n is cut still to finer tapes n' by a plurality of cutting blades 63 . . . as it is wound up by a known winding means 60.

As mentioned above, by means of the knit tape manufacturing device of the present invention, comprising cylindrical feeding and guiding mechanism composed of a plurality of feeding means arranged peripherally and supporting the circular knitted fabric stretched around the external surface of this feeding and guiding mechanism, wherein both rotation and feeding are done by the same driver, the circular knitted fabric is fed rotationally, longitudinally and uniformly and can be cut by the cutting means spirally into a tape of uniform width. Further, it is possible to have tubular knitted fabrics of different inside diameters by properly determining the outer diameter of the feeding and guiding mechanism by means of the diameter adjusting mechanism and by having the position of the cutting blade of the cutting means always in the given mutual position relationship by means of the position adjusting mechanism interlocked with the diameter adjusting mechanism, and by further synchronizing the speed of the rotary cutting blade by means of adjusting means utilizing a variable speed pulley etc. to the peripheral speed of the feeding and guiding mechanism to match the change in outer diameter thereof.

We claim:

1. A knit tape manufacturing device comprising:

a framework;

a driver supported on said framework;

a feeding and guiding mechanism composed of a plurality of feeding means which, arranged peripherally, are rotatively driven on said framework about a longitudinal axis by said driver through a power transmission mechanism and feeds under guidance along a longitudinal direction a circular knitted fabric stretched externally therearound;

an operating mechanism which operates said feeding means by said driver, said operating mechanism of said feeding means comprising a double shaft construction which changes the feeding speed by generating a relative difference between the rotary speeds of a hollow outer shaft and an inner shaft thereof, a geared power transmission means and relative difference adjustment means, said outer shaft being connected to said feeding and guiding mechanism and said inner shaft being connected to said operating mechanism; and a cutting means for cutting spirally the rotating circular knitted fabric into a tape of width corresponding to the specific feed length, said cutting means is located adjacent to the forward end of said feeding and guiding mechanism.

2. A knit tape manufacturing device as recited in claim 1 wherein said feeding and guiding mechanism has inverse ski shaped guide bar attached to the bracket of each feeding means at the circular knitted fabric receiving side.

3. A knit tape manufacturing device as recited in claim 1 or 2 wherein said feeding and guiding mechanism is connected with a diameter adjusting mechanism which enables radially uniform expansion or contraction of said mechanism.

4. A knit tape manufacturing device as recited in claim 1 wherein said cutting means comprises a pair of rotary blades and a means for adjusting such that the peripheral speed of said rotary blade at cutting point is equal to the peripheral speed on the external side of said feeding and guiding mechanism.

5. A knit tape manufacturing device as recited in claim 1 or 5 wherein said cutting means further comprises a position adjusting mechanism which follows variation in diametrical direction of said feeding and guiding means and adjusts said cutting point to the same level to the external side of said feeding and guiding means.

6. A knit tape manufacturing device as recited in claim 1 wherein said driver undertakes rotary driving of said feeding and guiding mechanism, feed driving of said feeding means and rotary driving said cutting means.

* * * * *